US005873790A

United States Patent [19]

Yeh

[11] Patent Number: 5,873,790

[45] Date of Patent: Feb. 23, 1999

[54] CONNECTING SOCKET OF GOLF CLUB HEAD

[76] Inventor: Wang-Chiu Yeh, No. 34, Feng Hua St., Hau Mei Tsun, Wu Sung Hsiang, Kaohsiung Hsien, Taiwan

[21] Appl. No.: 941,655

[22] Filed: Sep. 30, 1997

[51] Int. Cl.[6] ..... A63B 53/04

[52] U.S. Cl. ..... 473/305

[58] Field of Search ..... 473/305, 306, 473/307, 308, 309, 310, 311, 312, 313, 314, 315, 246, 248, 288

[56] References Cited

U.S. PATENT DOCUMENTS

| | | | |
|---|---|---|---|
| 4,655,457 | 4/1987 | Thompson | 473/246 |
| 5,222,734 | 6/1993 | Parente | 473/305 |
| 5,275,408 | 1/1994 | Desbiolles | 473/312 |
| 5,513,844 | 5/1996 | Ashcraft | 473/306 |
| 5,626,528 | 5/1997 | Toulon | 473/305 |

*Primary Examiner*—Sebastiano Passaniti
*Attorney, Agent, or Firm*—Varndell Legal Group

[57] ABSTRACT

The present invention relates to an improved connecting socket of the golf club head. The connecting socket 10 of the head 1 is a projected tube 11 having a through hole 110 thereof. A reinforced rib 12 is disposed between the head 1 and the projected tube 11. By this arrangement, the connecting portion 100 of the connecting socket 10 and the reinforced rib 12 can be forcibly pressed with or without heating. Accordingly, a little angular adjustment can be made to the connecting socket 10 by means of the projected tube 11. A shaft 2 can be readily mounted thereof and the striking area can be also increased.

7 Claims, 4 Drawing Sheets

CONNECTING SOCKET OF GOLF CLUB HEAD

FIELD OF THE INVENTION

The present invention relates to a club head having an improved connecting socket and wherein the connecting portion of the connecting socket and the reinforced rib can be forcibly pressed with or without heating. Accordingly, a little angular adjustment can be made to the connecting socket to achieve a desired angle for mounting the shaft thereon and the striking area can be also increased.

DESCRIPTION OF PRIOR ART

As shown in FIG. 1, the connecting socket of the existing gold head is projected over the top surface of the head and this may result in the following disadvantages when the head is assembled to the shaft, as referred to FIGS. 2 and 3.

1. Since the connecting socket is projected over the top surface of the head, the striking area is reduced, as shown in FIG. 1. Besides, the force exerting arm, defined by a distance between the center of gravity of the head to the center of the connecting socket, is comparatively shorter. As a result, the flying distance of the ball is short.

2. When the ball is hit by the head, the shock wave, as shown by arrow in FIG. 2, can be directly transmitted to the connecting socket. If this vibration is big, it can influence the holding of the shaft. As a result, the holding capability of the club is poor.

3. When assembling the head to the shaft by the engagement between the connecting socket and the lower end of the shaft, the axis of the connecting socket can become offset from the designed angle. It is difficult to correct this misalignment. Accordingly, the production of defective products can be increased.

4. If the connecting socket is offset resulted from improper use, it is impossible to adjust the connecting socket to obtain the desired angle for mounting the shaft.

It is difficult to adjust the connecting socket when the head is assembled to the shaft. The wall thickness can become too thin or even forming hole thereof resulted from improper drilling, as shown in FIG. 3.

Even if the connecting socket projects over the top surface of the head, it is difficult to achieve the correct the mounting angle for the shaft in the connecting socket, due to improper use of fixture demolding or, improper drilling. On the other hand, the wall thickness of the connecting socket can become overly thin.

As shown in FIG. 4, another suggestion for the connecting socket of the head is provided. The connecting socket is a through hole which passes through the head body and the shaft can be mounted therein. However, it is difficult to adjust the mounting angle between the shaft and the head by this through-hole because the shaft must be mounted in an interference fit manner. There is a little room for adjusting the angle. On the other hand, this arrangement may reduce the striking area of the head. The utility is poor.

DETAILED DESCRIPTION OF PREFERRED EMBODIMENT

The objective of the present invention is to provide an improved connecting socket for golf head wherein the connecting socket can be readily adjusted to get a perfect mounting. The connecting portion of the connecting socket and the reinforced rib can be forcibly pressed with or without heating and a suitable angular adjustment can be made to the connecting socket to achieve a desired angle for mounting the shaft thereon. Brief description will be made with the attached drawings.

Figure 1:
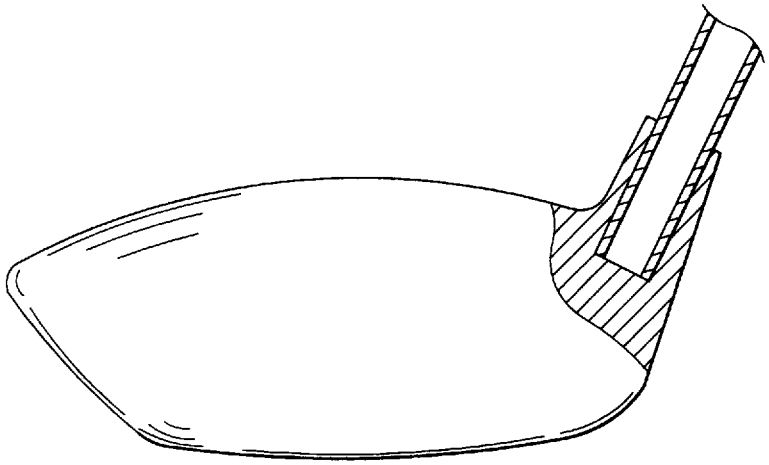
FIG. 1 PRIOR ART
FIG. 1 is a plan view of a conventional golf club head.
Figure 2:
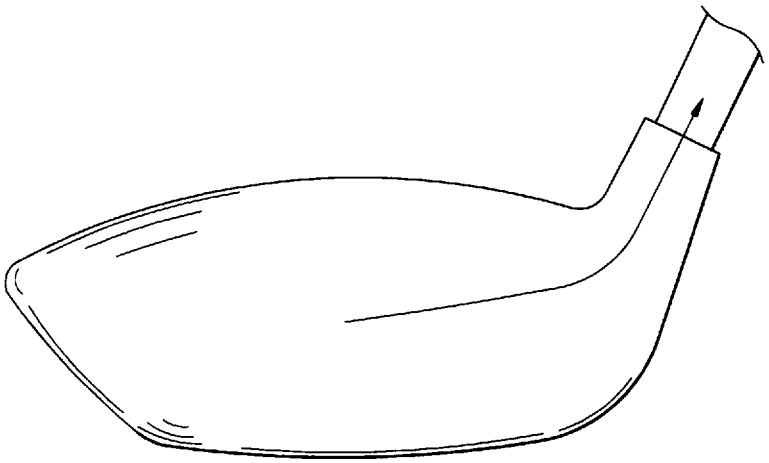
FIG. 2 PRIOR ART
FIG. 2 is a schematic illustration of the conventional golf club head showing the distribution direction of striking force.
Figure 3:
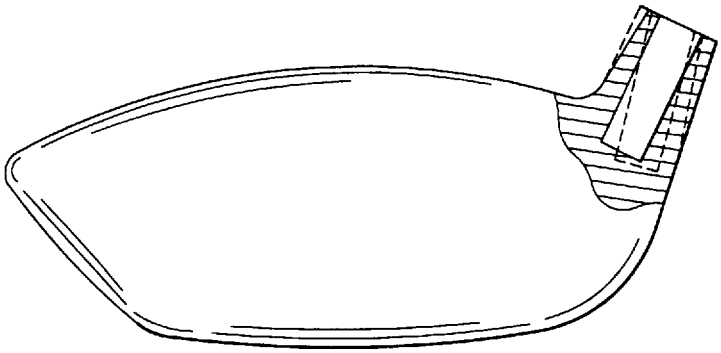
FIG.3 PRIOR ART
FIG. 3 is still a schematic illustration showing the improper drilling to the connecting socket of the conventional golf club head.
Figure 4:
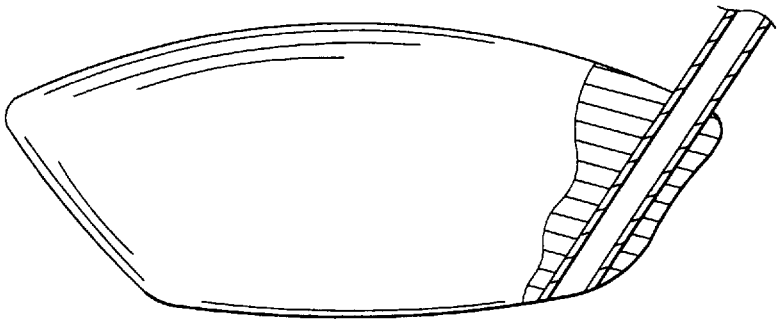
FIG.4 PRIOR ART
FIG. 4 is still a plan view of another conventional golf club head.
Figure 5:
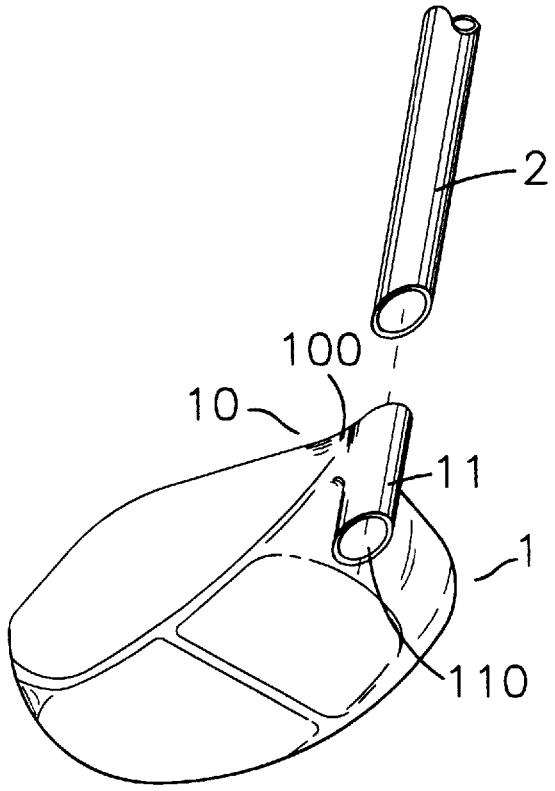
FIG. 5 is a perspective view of the present invention.
Figure 6:
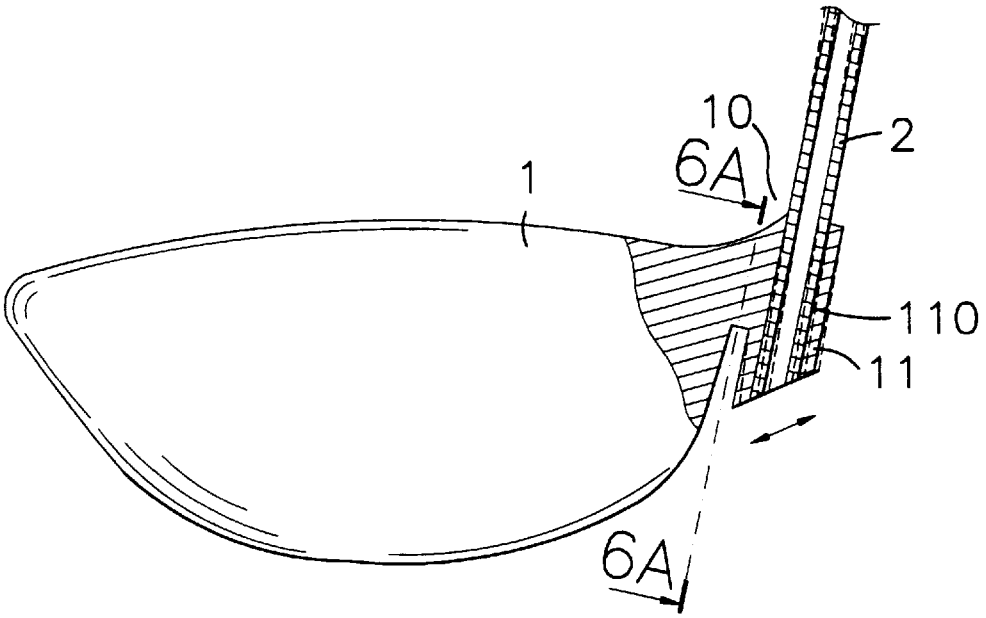
FIG. 6 is a schematic illustration of the projected tube of the connecting socket according to the present invention.
Figure 6A:
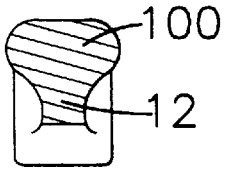
FIG. 6A is a cross sectional view taken from line 6A—6A of the connecting portion shown in FIG. 6.

Referring to FIGS. 5 and 6, the connecting socket 10 of the head 1 include a projected tube 11 having a through hole 110 thereof. A reinforced rib 12 is disposed between the head 1 and the projected tube 11, as clearly shown in FIG. 6A. By this arrangement, the connecting portion 100 of the connecting socket 10 and the reinforced rib 12 can be forcibly pressed with or without heating and a little angular adjustment can be made to the connecting socket 10 by means of the projected tube 11, which can be used to make corrections in angular adjustments that occur during manufacture of the golf clubs. A shaft 2 can be readily mounted in the connecting socket, and the striking area defined by the head 1 and the bottom center of the connecting socket 10 can be also increased.

Figure 7:
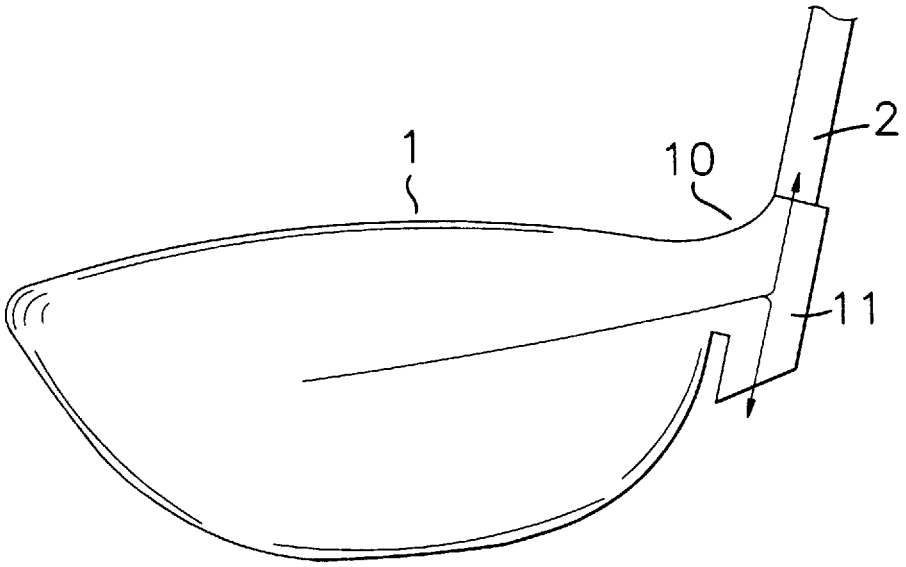
FIG. 7 is a schematic illustration of a golf head made according to the present invention showing the distribution direction of the striking force.

As shown in FIG. 7, when the head 1 is used to hit a ball, the shock wave, as shown by the arrow in FIG. 7, will be evenly distributed by the projected tube 11 as it is transmitted from the connecting portion 100. As the shock wave or vibration is evenly distributed and dissipated, these vibration will not transmitted to the handle, and the golfer may hold firmly of the golf club after hitting a nice shot.

Figure 8:
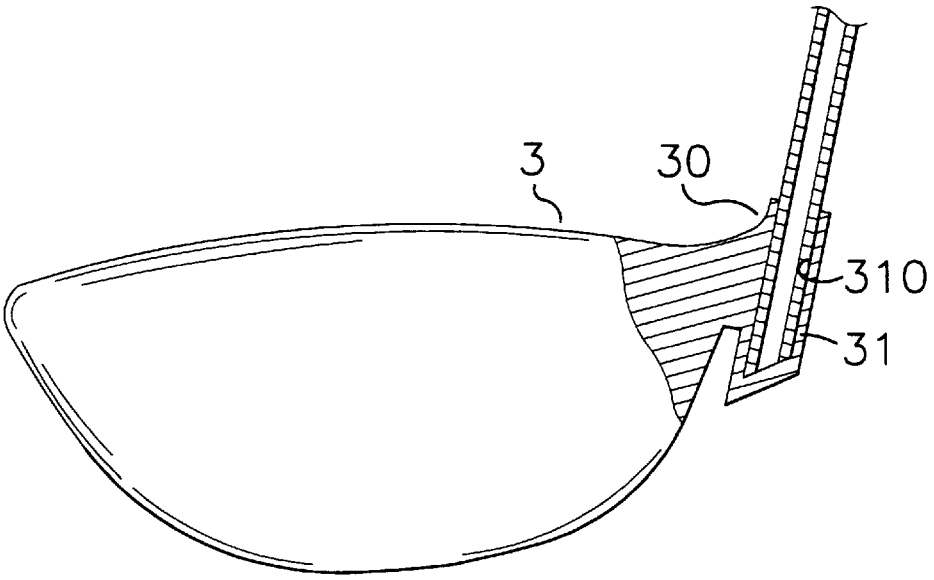
FIG. 8 is another embodiment of the golf head made according to the present invention.

Referring to FIG. 8, another embodiment of the present invention is shown,

The connecting socket 30 of the head 3 includes a projected tube 31 having a blind hole 310 thereof. The connecting portion of the connecting socket 30 and the reinforced rib can be forcibly pressed with or without heating, a little angular adjustment can be made to the connecting socket projected tube 31. Since this arrangement is identical to the previous embodiment, it is not shown in figures. By this arrangement, a suitable adjusting angle can be made to the projected tube 31 for mounting the shaft thereon.

The present invention can be concluded with the following characteristics.

1. The connecting socket of the head includes a projected tube having a through hole thereof. A reinforced rib is disposed between the head and the projected tube. The connecting portion of the connecting socket and the reinforced rib can be forcibly pressed with or without heating and a little angular adjustment can be made to the connecting socket by means of the projected tube.

2. The production defective rate can be reduced, and mounting angle ranges can be obtained that are wider than the conventional golf head, which has a fixed mounting angle making adjustment to a desired angle impossible. The striking area is also reduced. The present invention benefits a longer striking arm which is defined by a distance from the center of gravity of the head to the lower end of the connecting socket. As a result, the ball hit can have a longer flying distance. A nice shot can be attained.

3. The shock wave or vibration can be evenly distributed and dissipated by the projected tube as it is transmitted from the connecting portion. As the shock wave is reduced, the holding capability of the shaft can be therefore increased.

4. The present invention can be readily put for mass production which meet the economic requirements.

What I claim is:

1. A golf club having a shaft with a bottom fixed to a golf club head by a connecting socket, said connecting socket having a structure for permitting adjustment of an angular offset between said shaft and said golf club head and including a projected tube and a connection portion joining said projected tube and said golf club head, wherein said projected tube has a length greater than a length of said connection portion and includes a bottom portion extending below said connection portion for forming a clearance between said projected tube and said golf club head for absorbing a portion of a shock wave when said golf club head is used to strike a ball.

2. The golf club of claim 1, wherein said connecting socket is arranged adjacent a striking face of said golf club head, so that a striking area defined by an end of said golf club head opposite said connecting socket and a bottom center of said connecting socket is increased.

3. The golf club of claim 1, wherein said projected tube includes an integrally formed blind hole, and said shaft fits in said projected tube and said bottom of said shaft abuts a bottom of said blind hole.

4. A golf club having a shaft with a bottom fixed to a golf club head by a connecting socket, said connecting socket having a structure for permitting adjustment of an angular offset between said shaft and said golf club head and including a projected tube, a connection portion joining said projected tube and said golf club head, and a reinforced rib joining said projected tube and said golf club head and connected to said connection portion, wherein said projected tube has a length greater than a combined length of said connection portion and said reinforcing rib and includes a bottom portion extending below said connection portion and said reinforcing rib for forming a clearance between said projected tube and said golf club head for absorbing a portion of a shock wave when said golf club head is used to strike a ball.

5. The golf club of claim 4, wherein said connecting socket is arranged adjacent a striking face of said golf club head, so that a striking area defined by an end of said golf club head opposite said connecting socket and a bottom center of said connecting socket is increased.

6. The golf club of claim 4, wherein said projected tube includes an integrally formed blind hole, and said shaft fits in said projected tube and said bottom of said shaft abuts a bottom of said blind hole.

7. The golf club of claim 4, wherein said reinforcing rib is arranged below said connecting portion and has a width smaller than a width of said connecting portion.

* * * * *